US009281663B2

(12) United States Patent
Johnson

(10) Patent No.: US 9,281,663 B2
(45) Date of Patent: Mar. 8, 2016

(54) GENERAL AVIATION IGNITER CABLE ASSEMBLY

(71) Applicant: Howard Johnson, El Segundo, CA (US)

(72) Inventor: Howard Johnson, El Segundo, CA (US)

( * ) Notice: Subject to any disclaimer, the term of this patent is extended or adjusted under 35 U.S.C. 154(b) by 573 days.

(21) Appl. No.: 13/871,938

(22) Filed: Apr. 26, 2013

(65) Prior Publication Data

US 2014/0322937 A1 Oct. 30, 2014

(51) Int. Cl.
*H01R 13/44* (2006.01)
*H01T 13/05* (2006.01)
*H01R 13/53* (2006.01)

(52) U.S. Cl.
CPC ..... *H01T 13/05* (2013.01); *H01R 13/53* (2013.01)

(58) Field of Classification Search
CPC ..... H01R 13/44; H01R 13/52; H01T 13/04; H01T 13/05; H01T 13/06; F02P 7/025
USPC ..... 123/633, 169 PH, 169 PA; 439/126, 125, 439/127, 128
See application file for complete search history.

(56) References Cited

U.S. PATENT DOCUMENTS 2,118,673 A 5/1938 Green
2,150,723 A * 3/1939 Nowosielski ..... 123/169 C
2,478,087 A * 8/1949 Bychinsky ..... H01T 13/44 123/169 PA
3,334,326 A * 8/1967 Besore ..... H01T 13/06 313/135
3,965,879 A * 6/1976 Fitzner ..... H01T 13/05 123/169 PH
4,145,106 A 3/1979 Livingston
4,150,865 A * 4/1979 Iliff ..... H01R 13/5205 439/126
5,603,306 A * 2/1997 Tai ..... H01B 7/0063 123/169 PH
5,618,193 A 4/1997 Nakajima et al.
5,630,722 A 5/1997 Mochizuki et al.
5,749,742 A * 5/1998 Bertuzzi, Jr. ..... H01R 13/6276 439/125
5,827,079 A 10/1998 Murata
5,957,706 A 9/1999 Phillips, Jr. et al.
6,192,873 B1 2/2001 Adachi et al.
6,247,943 B1 * 6/2001 Moga ..... H01R 13/2421 439/125
6,340,303 B2 1/2002 Hamada et al.
6,358,072 B1 * 3/2002 Johnson ..... H01R 13/53 123/169 PH
6,443,137 B1 9/2002 Kraft et al.
6,467,447 B1 10/2002 Holmes et al.
6,668,810 B1 12/2003 St. John et al.
6,679,236 B2 1/2004 Skinner et al.
6,684,621 B1 2/2004 Johnson
7,065,956 B2 6/2006 Johnson
7,152,593 B2 12/2006 Sikora
7,185,622 B2 3/2007 Doll
7,441,553 B2 10/2008 Satoh
7,455,536 B2 11/2008 Virchow (Continued)

*Primary Examiner* — Hai Huynh
*Assistant Examiner* — Raza Najmuddin
(74) *Attorney, Agent, or Firm* — David A. Belasco; Belasco Jacobs & Townsley, LLP

(57) ABSTRACT

An improved general aviation igniter cable assembly includes either a single or double coil spring. The double coil spring has inner and outer portions. The outer portion has first and second ends. The first end rotatably engages the cylindrical recess in the ferrule. The outer portion surrounds the first end of the grommet with the second end bearing against the retainer. The distal end of the inner portion is located within the outer portion and bears against the first end of the grommet to put pressure on the spark plug contact button. For the magneto end of the cable, a sealing grommet fits slidably over an insulating sleeve of the cable and seals against a magneto plate when a surrounding threaded nut is tightened into a collar of the magneto plate and the plate is attached to a magneto, providing an airtight seal to the magneto plate and the magneto.

8 Claims, 4 Drawing Sheets

(56) References Cited

U.S. PATENT DOCUMENTS 7,629,869 B2 12/2009 Fujiyama 8,151,781 B2 * 4/2012 Lykowski ..... H01T 13/04
123/143 B

* cited by examiner

GENERAL AVIATION IGNITER CABLE ASSEMBLY

FIELD OF INVENTION

The invention pertains to high voltage ignition cable connectors. More particularly, the invention relates to moisture proof connectors for igniter leads for general aviation aircraft engines.

BACKGROUND OF THE INVENTION

General aviation aircraft engines are subject to a variety of high stress conditions that may compromise the electrical conductivity of the cables and their connectors at both the spark plug and magnetos ends. These engines produce very high temperatures and may be used in both very hot and very cold environments. High altitude application and high humidity conditions also threaten connector and cable integrity. Because of these challenging conditions, igniter cable connectors must be watertight and must not be affected by changing temperature, pressure and humidity conditions. For these reasons, various types of high voltage ignition cable connectors and igniter leads have been developed for use in aircraft engines.

U.S. Pat. No. 6,668,810 issued to St. John et al. is directed to an ignition coil assembly with spark plug connector to provide more reliable electrical connection between the high voltage terminal of the ignition coil and the spark plug terminal. This invention provides for a spark plug boot formed of a highly resilient material with an internal coil type high voltage connection spring in the boot section that electrically contacts the coil and the spark plug terminals. The internal passageway of the coil boot features a uniform cylindrical diameter with a number of ribs that are provided to engage the center section of the coil type spring specifically the center section of said spring that has a radius greater than the end segments thereof. A connection spring has a center section with an outside diameter that is slightly less than the inside diameter of the boot passageway. The boot passageway has a plurality of radially inwardly protruding ribs that engage with the center portion of the spring thus ensuring that the boot is held in place and thus the spring maintains an effective connection with the high voltage terminal of the spark plug.

U.S. Pat. No. 5,957,706 issued to Phillips, Jr. et al. is directed to an ignition cable terminal assembly that includes a coil spring that engages the upper annular shoulder of a ring gear that biases the ring downwardly against a lower gear. Ultimately this produces a tight motion-free engagement of the terminal assembly with the stud terminal which is plugged into the spark plug.

U.S. Pat. No. 5,827,079, issued to Murata is directed to an electric connection member, ignition apparatus for internal combustion engine and manufacturing method thereof. The conductor is composed of a coil spring with a contact member that connects the coil to the spark plug. This invention includes a coil spring with a large diameter portion which is smaller than the inside diameter of a cylinder portion of a first rubber cap and the inside diameter of the adapter. The contact member from the coil then connects through the spring to a high-tension terminal of the spark plug. A groove portion of the inside wall of the adapter prevents the rotation of the contact member.

U.S. Pat. No. 5,630,722 issued to Mochizuki et al. describes an ignition cable connection fitting to which a high voltage current is supplied. The connection is made by means of a contact spring connecting to a contact member by means of a terminal of a spark plug. A coil spring acts on the ignition cable connection which in turn is held in position about the spark plug by means of a locking device that engages the connection fitting with the spark plug so that the connection is not easily disconnected.

U.S. Pat. No. 2,398,359 issued to Curtiss discloses a shielded elbow shell spark plug connector. The spark plug connector has one end connected to an aviation spark plug and the other end connected to an electrical conductor. The connector has a hollow metal elbow or shell that is formed of two complementary pressed sheet metal shell halves brazed together and having a union brazed to end and a retainer is brazed to the spark plug connection arm. The completed metal elbow shell is placed in a die with an electrical conductor or cable connector insert held in spaced relation for a molding operation of plastic insulating material that is forced inside.

While other variations exist, the above-described designs for high voltage ignition cable connectors and igniter leads are typical of those encountered in the prior art. It is an objective of the present invention to provide a securely fastenable general aviation engine igniter lead assembly. It is a further objective to provide an igniter cable assembly that provides complete sealing against moisture and dirt found in the aviation environment. It is yet a further objective to provide an igniter assembly that may be easily disassembled and reassembled for maintenance purposes without damage to the assembly or the igniter components. It is an additional objective of the invention that the connection to the magneto end of the igniter cable be removable from the magneto housing without removing the entire housing. It is a final further objective of the invention to provide the above-described capabilities in an inexpensive and durable connector that is capable of extended duty cycles. While some of the objectives of the present invention are disclosed in the prior art, none of the inventions found include all of the requirements identified.

SUMMARY OF THE INVENTION

The present invention addresses all of the deficiencies of prior art general aviation igniter cable assembly inventions and satisfies all of the objectives described above. assembly of the present invention may be constructed from the following components.

(1) An improved general aviation igniter cable assembly of the present invention may be constructed from the following components. A radio-shielded ignition cable is provided. The cable has an outer insulating cover, a shielding conductor, an inner insulating layer, and a center conductor. A flexible, conducting, elbow tube is provided. The elbow tube has a first end and a second end and is fixedly and conductively attached at its first end to the shielding conductor of the cable. The elbow tube retains a particular shape after bending. A sealing sleeve is provided. The sleeve joins the outer insulating cover to the first end of the elbow tube. A threaded nut is provided. The nut has a central orifice through it, a first end, a second end and a retaining lip at the first end. The nut has an internal thread extending from the second end toward the retaining lip.

A conducting ferrule is provided. The ferrule is cylindrical in shape and has a central orifice through it. The ferrule has a body portion and a retaining portion. The body portion has a first end and a second end and is sized and shaped to fit slidably through the orifice in the threaded nut. The body portion is fixedly and conductively attached at its first end to the second end of the elbow tube. The retaining portion has a first end and a second end. The first end extends from the second end of the body portion and is sized and shaped to bear rotatably against the retaining lip of the threaded nut. The second end of the retaining portion includes a cylindrical recess.

A cylindrical grommet is provided. The grommet has a first end, a second end, is formed of resilient, insulating material and is sized and shaped to fit slidably over the inner insulating layer of the cable. The grommet includes a surrounding shoulder located between the first end and the second end. A retainer is provided. The retainer is sized and shaped to fit slidably over the first end of the grommet and bear against the surrounding shoulder. A spark plug contact button is provided. The button is fixedly and conductively attached to the center conductor of the cable adjacent the second end of the grommet. A cylindrical protector cap is provided. The cap is formed of insulating material and includes an inner chamber and an external thread. The thread is size and shaped to engage the internal thread of the threaded nut.

The improvement includes a double coil spring. The double coil spring has an inner portion and an outer portion. The outer portion has a first end and a second end. The first end is sized and shaped to rotatably engage the cylindrical recess. The outer portion is sized and shaped to surround the first end of the grommet with the second end bearing against the retainer. The inner portion is located within the outer portion, has a proximate end and a distal end. The distal end is sized and shaped to bear against the first end of the grommet and put pressure on the spark plug contact button. When the protector cap is unthreaded from the threaded nut and a spark plug of an aircraft engine is inserted into the cap and threaded into an engine cylinder head with the spark plug contact button bearing against a central spark plug conductor and when the threaded nut is threaded onto the external thread of the cap, the double coil spring will be compressed, causing the spark plug contact button to bear against the central spark plug conductor, thereby providing a moisture-resistant connection between the cable and the sparkplug.

(2) In a variant of the invention, the flexible, conducting, elbow tube is formed from a sheet of malleable metallic material. The sheet has first and second, opposed parallel edges and third and fourth, opposed parallel edges normal to the first and second edges. The sheet has a series of single, back to back folds parallel to the third and fourth edges. The sheet is formed about a cylindrical mandrel. A long axis of the mandrel is perpendicular to the folds. The first and second edges are joined to form an open-ended cylindrical tube.

(3) In another variant, the flexible, conducting, elbow tube is formed from a sheet of malleable metallic material. The sheet has first and second, opposed parallel edges and third and fourth, opposed parallel edges normal to the first and second edges. The sheet has a series of single, back to back folds parallel to the third and fourth edges. Lower portions of the folds are doubled back upon themselves so as to provide four layers of metallic material adjacent to a lower surface of the sheet. The sheet is formed about a cylindrical mandrel with the lower surface outermost. A long axis of the mandrel is perpendicular to the folds. The first and second edges are joined to form an open-ended cylindrical tube that has a reinforced outer surface.

(4) In still another variant, a radio-shielded ignition cable is provided. The cable has an outer insulating cover, a shielding conductor, an inner insulating layer, and a center conductor. A flexible, conducting, elbow tube is provided. The tube has a first end and a second end and is fixedly and conductively attached at its first end to the shielding conductor of the cable. The elbow tube retains a particular shape after bending. A sealing sleeve is provided. The sleeve joins the outer insulating cover to the first end of the elbow tube. A threaded nut is provided. The nut has a central orifice through it. The nut has a first end, a second end, a retaining lip at the first end and an internal thread extending from the second end toward the retaining lip.

A conducting ferrule is provided. The ferrule is cylindrical in shape, has a central orifice through it, and has a body portion and a retaining portion. The body portion has a first end and a second end and is sized and shaped to fit slidably through the orifice in the threaded nut. The body portion is fixedly and conductively attached at its first end to the second end of the elbow tube. The retaining portion has a first end and a second end. The first end extends from the second end of the body portion and is sized and shaped to bear rotatably against the retaining lip of the threaded nut. The second end of the retaining portion includes a cylindrical recess.

The improvement includes a coil spring. The coil spring has a first end and a second end and is sized and shaped to fit slidably within the cylindrical recess. A retainer is provided. The retainer is sized and shaped to fit slidably within the cylindrical recess adjacent the second end of the coil spring. A cylindrical grommet is provided. The grommet has a first end, a second end, is formed of resilient, insulating material. The grommet is sized and shaped to fit slidably over the inner insulating layer of the cable. The grommet includes a surrounding shoulder located adjacent the first end. The shoulder is sized and shaped to fit frictionally within the cylindrical recess in the second end of the retaining portion of the ferrule.

A spark plug contact button is provided. The button is fixedly and conductively attached to the center conductor of the cable adjacent the second end of the grommet. A cylindrical protector cap is provided. The cap is formed of insulating material and includes an inner chamber and an external thread. The thread is size and shaped to engage the internal thread of the threaded nut. When the protector cap is unthreaded from the threaded nut and a spark plug of an aircraft engine is inserted into the cap and threaded into an engine cylinder head with the spark plug contact button bearing against a central spark plug conductor and when the threaded nut is threaded onto an external thread of the cap, the coil spring will be compressed, causing the spark plug contact button to bear against the central spark plug conductor, thereby providing a moisture-resistant connection between the cable and the sparkplug.

(5) In yet another variant, the flexible, conducting, elbow tube is formed from a sheet of malleable metallic material. The sheet has first and second, opposed parallel edges and third and fourth, opposed parallel edges normal to the first and second edges. The sheet has a series of single, back to back folds parallel to the third and fourth edges. The sheet is formed about a cylindrical mandrel. A long axis of the mandrel is perpendicular to the folds. The first and second edges are joined to form an open-ended cylindrical tube.

(6) In a further variant, the flexible, conducting, elbow tube is formed from a sheet of malleable metallic material. The sheet has first and second, opposed parallel edges and third and fourth, opposed parallel edges normal to the first and second edges. The sheet has a series of single, back to back folds parallel to the third and fourth edges. Lower portions of the folds are doubled back upon themselves so as to provide four layers of metallic material adjacent a lower surface of the sheet. The sheet is formed about a cylindrical mandrel with the lower surface outermost. A long axis of the mandrel is perpendicular to the folds. The first and second edges are joined to form an open-ended cylindrical tube has a reinforced outer surface.

(7) In still a further variant, an insulating sleeve is provided. The sleeve has a first end, a second end, is sized and shaped to fit slidably over the inner insulating layer and is located adjacent a posterior end of the cable. The insulating sleeve is sized and shaped to fit slidably within a receiving collar of a magneto plate. A contact button is provided. The button is attached to a posterior end of the center conductor of the ignition cable. An externally threaded nut is provided. The nut has a central orifice through it. The nut has an anterior end, a posterior end, an external bearing surface at the posterior end. A support ferrule is provided. The ferrule has a first end, a second end and a central opening extending from the first end to the second end. The opening is sized to fit slidably over the insulating sleeve. The first end of the support ferrule is sized and shaped to fit within the externally threaded nut. The second end of the support ferrule is sized and shaped to bear against the external bearing surface of the externally threaded nut.

A sealing grommet is provided. The grommet has an anterior end, a posterior end and is formed of resilient material. The grommet has a central aperture extending from the anterior end to the posterior end. The central aperture is sized to fit slidably over the insulating sleeve. The sealing grommet is compressed to seal against the magneto plate when the externally threaded nut is attached to and tightened into the receiving collar, and said magneto plate is attached to a magneto thereby providing an airtight seal for the connection to the magneto plate and said magneto.

(8) In a final variant, an insulating sleeve is provided. The sleeve has a first end, a second end, is sized and shaped to fit slidably over the inner insulating layer and is located adjacent a posterior end of the cable. The insulating sleeve is sized and shaped to fit slidably within a receiving collar of a magneto plate. A contact button is provided. The button is attached to a posterior end of the center conductor of the ignition cable. An externally threaded nut is provided. The nut has a central orifice through it. The nut has an anterior end, a posterior end, an external bearing surface at the posterior end. A support ferrule is provided. The ferrule has a first end, a second end and a central opening extending from the first end to the second end. The opening is sized to fit slidably over the insulating sleeve. The first end of the support ferrule is sized and shaped to fit within the externally threaded nut. The second end of the support ferrule is sized and shaped to bear against the external bearing surface of the externally threaded nut.

A sealing grommet is provided. The grommet has an anterior end, a posterior end and is formed of resilient material. The grommet has a central aperture extending from the anterior end to the posterior end. The central aperture is sized to fit slidably over the insulating sleeve. The sealing grommet is compressed to seal against the magneto plate when the externally threaded nut is attached to and tightened into the receiving collar, and said magneto plate is attached to a magneto thereby providing an airtight seal for the connection to the magneto plate and said magneto.

A sealing grommet is provided. The grommet has an anterior end, a posterior end and is formed of resilient material. The grommet is sized and shaped to fit slidably within a receiving collar of a magneto plate when the grommet is in an uncompressed state and has a central aperture extending from the anterior end to the posterior end. The central aperture is sized to fit slidably over the insulating sleeve. The sealing grommet is compressed to seal against the receiving collar of the magneto plate when the externally threaded nut is attached to and tightened into the receiving collar, thereby providing an airtight seal for the connection to the magneto plate.

DESCRIPTION OF THE DRAWINGS

DETAILED DESCRIPTION OF THE PREFERRED EMBODIMENT (1) FIGS. 1-9 illustrate an improved general aviation igniter cable assembly 10 of the present invention that may be constructed from the following components. As illustrated in FIG. 3, radio-shielded ignition cable 14 is provided. The cable 14 has an outer insulating cover 18, a shielding conductor 22, an inner insulating layer 26, and a center conductor 30. A flexible, conducting, elbow tube 34 is provided. The elbow tube 34 has a first end 38 and a second end 42 and is fixedly and conductively attached at its first end 38 to the shielding conductor 22 of the cable 14. The elbow tube 34 retains a particular shape 46 after bending A sealing sleeve 50 is provided. The sleeve 50 joins the outer insulating cover 18 to the first end 38 of the elbow tube 34. A threaded nut 54 is provided. The nut 54 has a central orifice 58 through it, a first end 62, a second end 66 and a retaining lip 70 at the first end 62. The nut 54 has an internal thread 74 extending from the second end 66 toward the retaining lip 70.

Figures 1, 4:
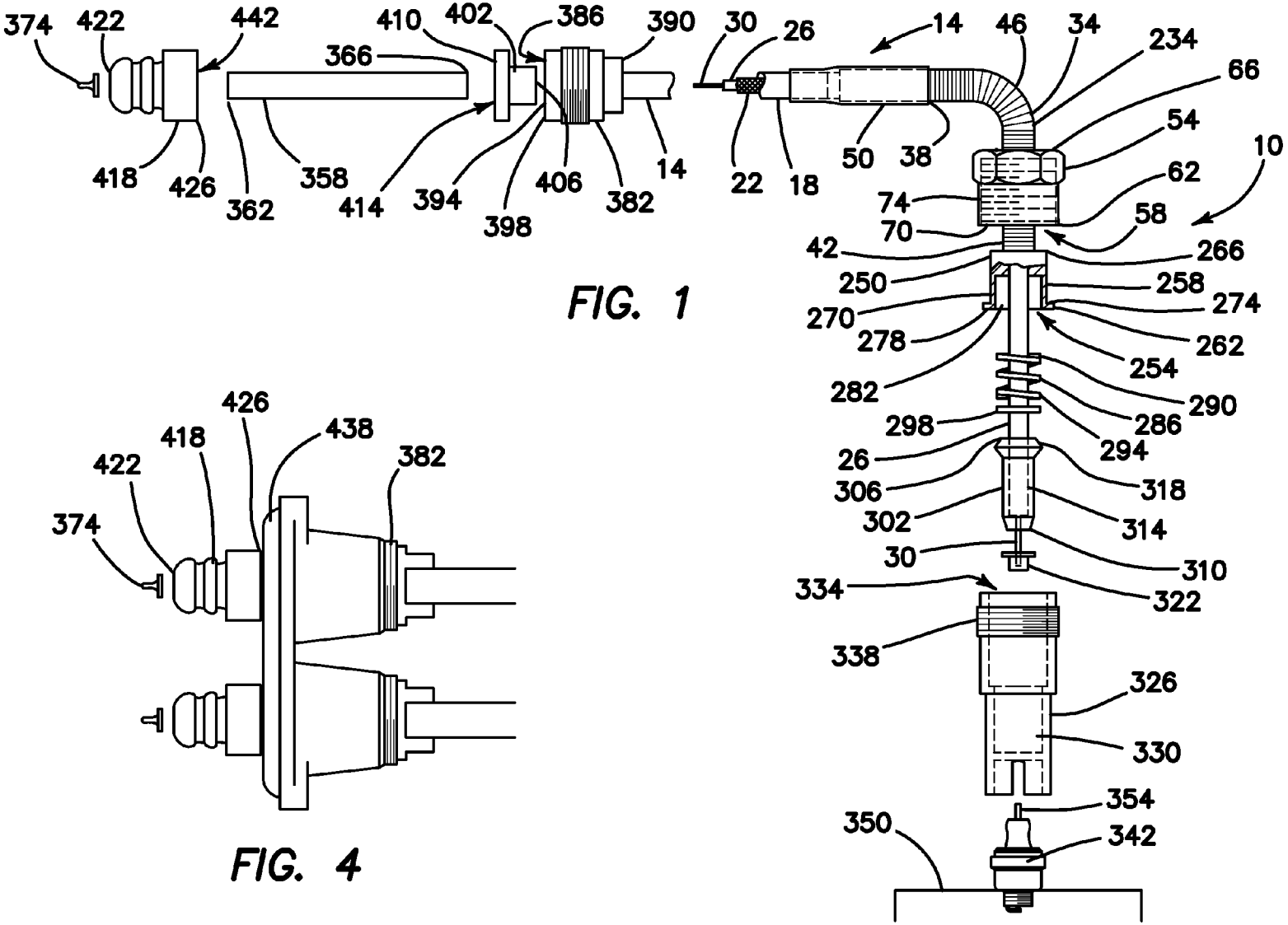
FIG. 1 is a side elevational view of a first embodiment of the invention assembled with an igniter lead.
FIG. 4 is a side elevational view of the magneto end of a pair of igniter cables.
Figure 2:
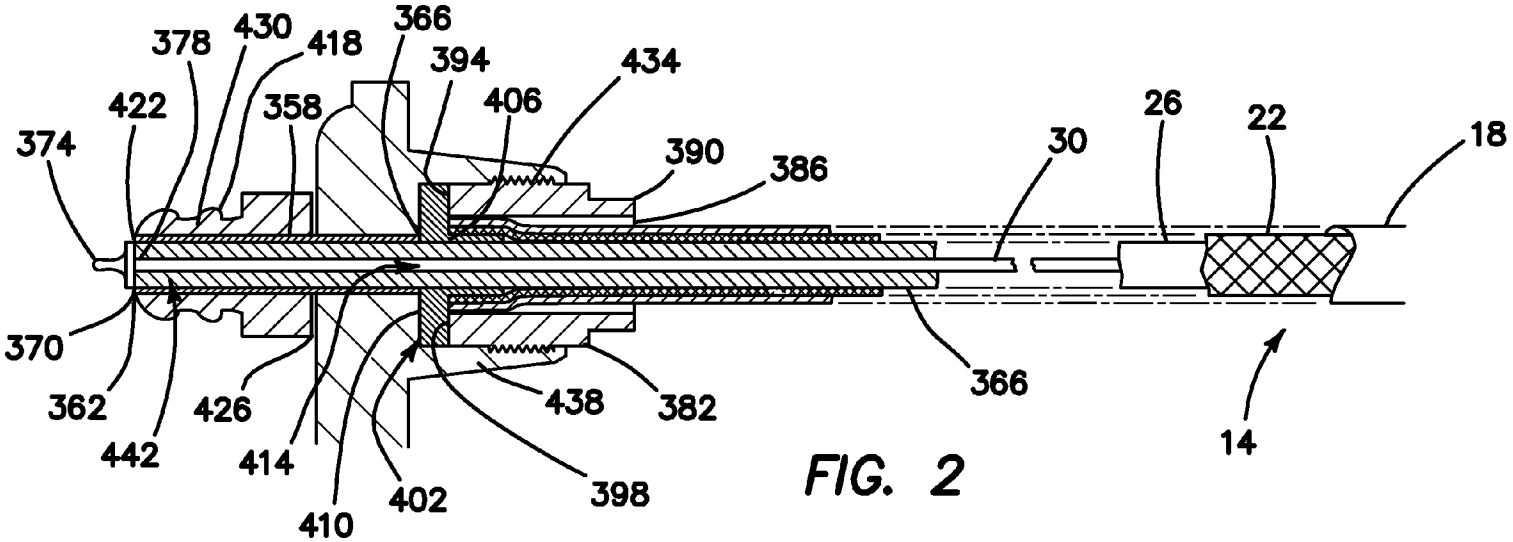
FIG. 2 is an enlarged elevational view of the magneto end of the invention.
Figure 7:
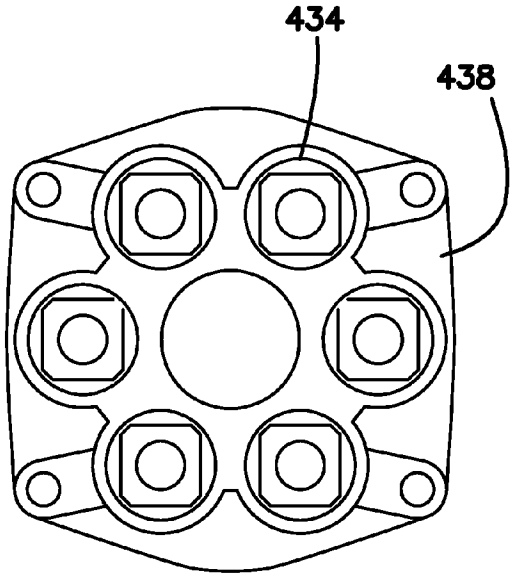
FIG. 7 is a plan view of a six connector magneto plate.
Figure 6:
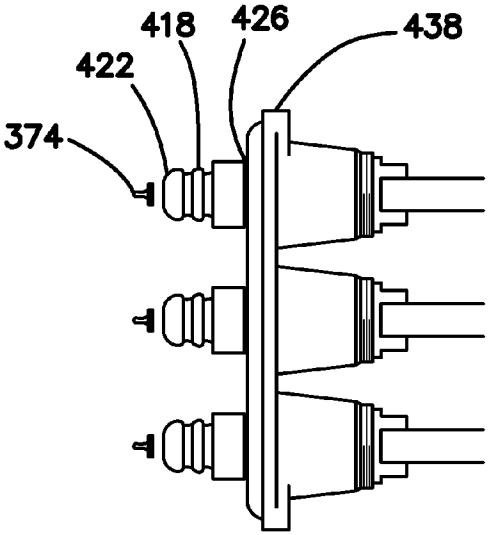
FIG. 6 is a side elevational view of the magneto end of three of igniter cables.
Figure 3:
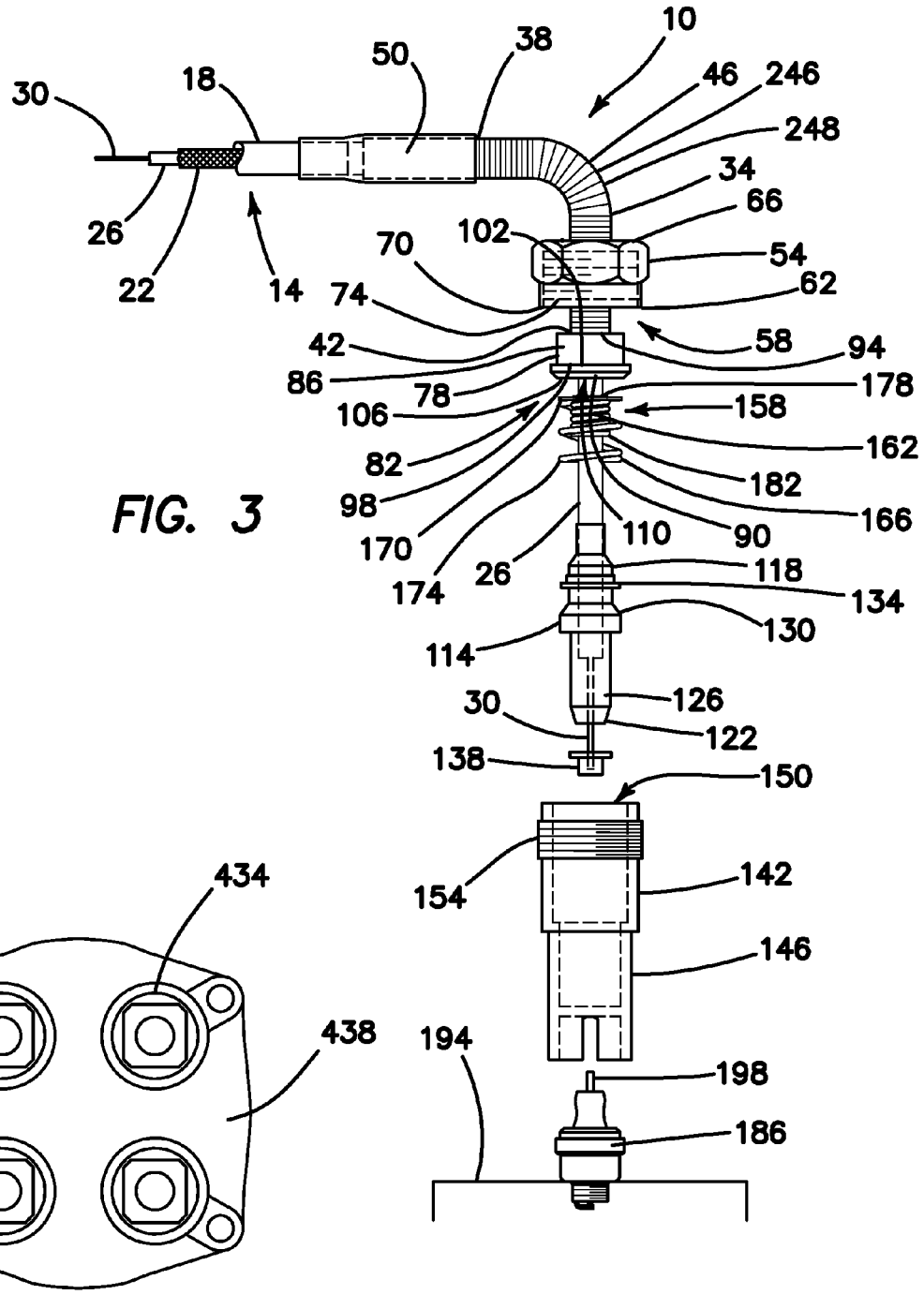
FIG. 3 is a side elevational view of the spark plug end of a second embodiment of the invention.
Figure 5:
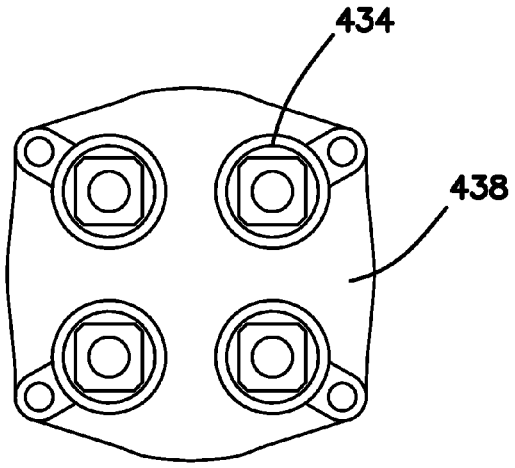
FIG. 5 is a plan view of a four connector magneto plate.

A conducting ferrule 78 is provided. The ferrule 78 is cylindrical in shape and has a central orifice 82 through it. The ferrule 78 has a body portion 86 and a retaining portion 90. The body portion 86 has a first end 94 and a second end 98 and is sized and shaped to fit slidably through the orifice 58 in the threaded nut 54. The body portion 86 is fixedly and conductively attached at its first end 94 to the second end 42 of the elbow tube 34. The retaining portion 90 has a first end 102 and a second end 106. The first end 102 extends from the second end 98 of the body portion 86 and is sized and shaped to bear rotatably against the retaining lip 70 of the threaded nut 54. The second end 106 of the retaining portion 90 includes a cylindrical recess 110.

A cylindrical grommet 114 is provided. The grommet 114 has a first end 118, a second end 122, is formed of resilient, insulating material 126 and is sized and shaped to fit slidably over the inner insulating layer 26 of the cable 14. The grommet 114 includes a surrounding shoulder 130 located between the first end 118 and the second end 122. A retainer 134 is provided. The retainer 134 is sized and shaped to fit slidably over the first end 118 of the grommet 114 and bear against the surrounding shoulder 130. A spark plug contact button 138 is provided. The button 138 is fixedly and conductively attached to the center conductor 30 of the cable 14 adjacent the second end 122 of the grommet 114. A cylindrical protector cap 142 is provided. The cap 142 is formed of insulating material 146 and includes an inner chamber 150 and an external thread 154. The thread 154 is size and shaped to engage the internal thread 74 of the threaded nut 54.

The improvement includes a double coil spring 158. The double coil spring 158 has an inner portion 162 and an outer portion 166. The outer portion 166 has a first end 170 and a second end 174. The first end 170 is sized and shaped to rotatably engage the cylindrical recess 110. The outer portion 166 is sized and shaped to surround the first end 118 of the grommet 114 with the second end 174 bearing against the retainer 134. The inner portion 162 is located within the outer portion 166, has a proximate end 178 and a distal end 182. The distal end 182 is sized and shaped to bear against the first end 118 of the grommet 114 and put pressure on the spark plug contact button 138. When the protector cap 142 is unthreaded from the threaded nut 54 and a spark plug 186 of an aircraft engine 190 is inserted into the cap 142 and threaded into an engine cylinder head 194 with the spark plug contact button 138 bearing against a central spark plug conductor 198 and when the threaded nut 54 is threaded onto the external thread 154 of the cap 142, the double coil spring 158 will be compressed, causing the spark plug contact button 138 to bear against the central spark plug conductor 198, thereby providing a moisture-resistant connection between the cable 14 and the sparkplug 186.

Figure 8:
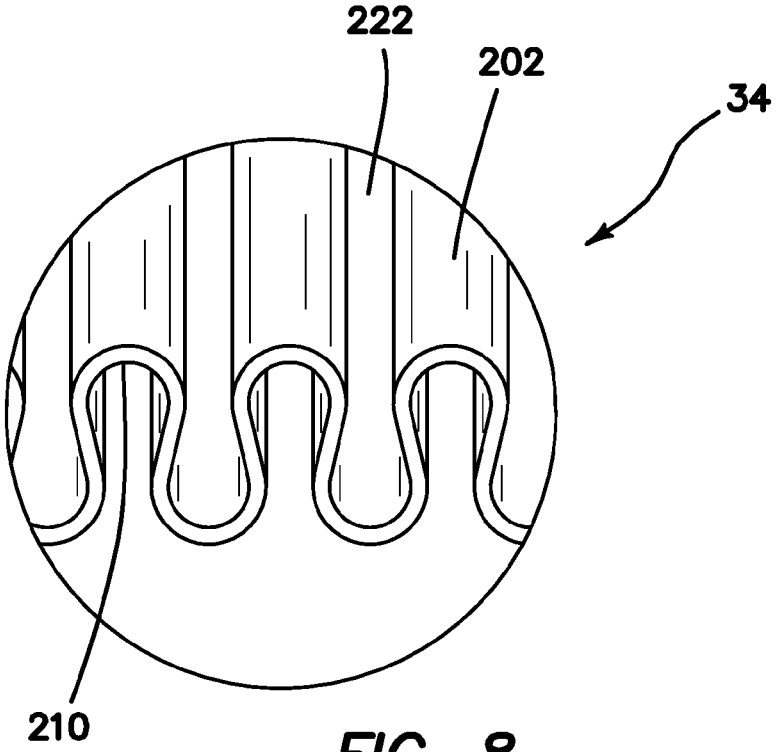
FIG. 8 is a close-up perspective view of a first embodiment of the partially formed conducting elbow tube.

(2) In a variant of the invention, as illustrated in FIG. 8, the flexible, conducting, elbow tube 34 is formed from a sheet of malleable metallic material 202. The sheet 202 has first (not shown) and second 210, opposed parallel edges and third (not shown) and fourth (not shown), opposed parallel edges normal to the first and second 210 edges. The sheet 202 has a series of single, back to back folds 222 parallel to the third and fourth edges. The sheet 202 is formed about a cylindrical mandrel (not shown). A long axis (not shown) of the mandrel is perpendicular to the folds 222. The first and second 210 edges are joined to form an open-ended cylindrical tube 234.

Figure 9:
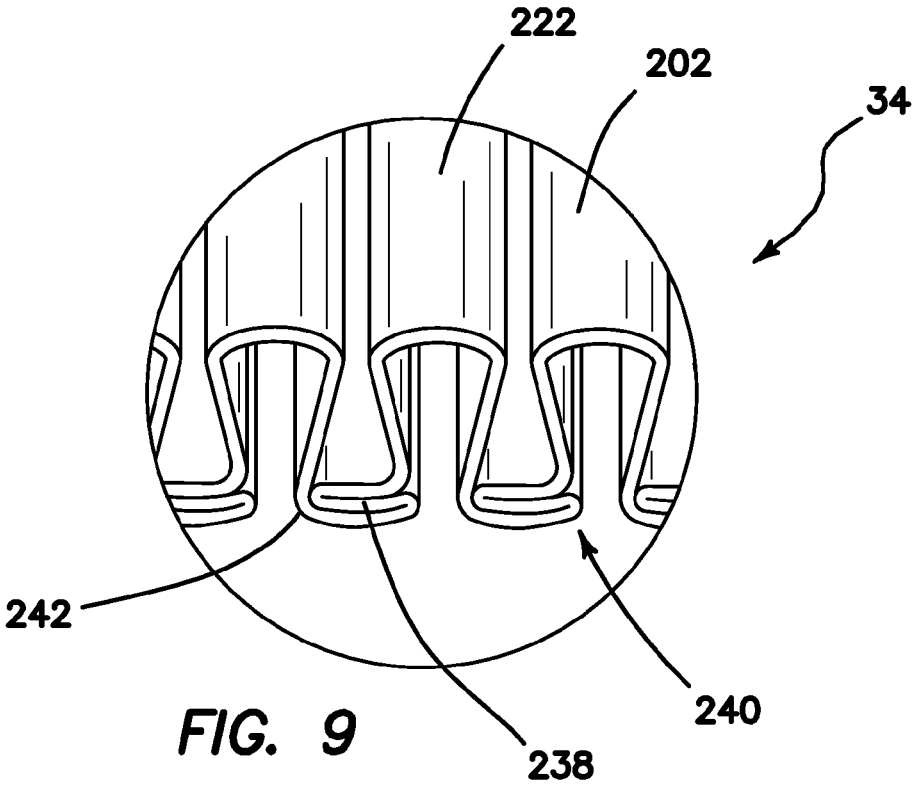
FIG. 9 is a close-up perspective view of a second embodiment of the partially formed conducting elbow tube.

(3) In another variant, as illustrated in FIG. 9, the flexible, conducting, elbow tube 34 is formed from a sheet of malleable metallic material 202. The sheet has first (not shown) and second 210, opposed parallel edges and third (not shown) and fourth (not shown), opposed parallel edges normal to the first and second 210 edges. The sheet 202 has a series of single, back to back folds 222 parallel to the third and fourth edges. Lower portions 238 of the folds 222 are doubled back upon themselves so as to provide four layers of metallic material 240 adjacent to a lower surface 242 of the sheet 202. The sheet 202 is formed about a cylindrical mandrel (not shown) with the lower surface 242 outermost. A long axis (not shown) of the mandrel is perpendicular to the folds 222. The first and second 210 edges are joined to form an open-ended cylindrical tube 246 that has a reinforced outer surface 248.

(4) In still another variant, as illustrated in FIG. 1, a radio-shielded ignition cable 14 is provided. The cable 14 has an outer insulating cover 18, a shielding conductor 22, an inner insulating layer 26, and a center conductor 30. A flexible, conducting, elbow tube 34 is provided. The elbow tube 34 has a first end 38 and a second end 42 and is fixedly and conductively attached at its first end 38 to the shielding conductor 22 of the cable 14. The elbow tube 34 retains a particular shape 46 after bending A sealing sleeve 50 is provided. The sleeve 50 joins the outer insulating cover 18 to the first end 38 of the elbow tube 34. A threaded nut 54 is provided. The nut 54 has a central orifice 58 through it, a first end 62, a second end 66 and a retaining lip 70 at the first end 62. The nut 54 has an internal thread 74 extending from the second end 66 toward the retaining lip 70.

A conducting ferrule 250 is provided. The ferrule 250 is cylindrical in shape and has a central orifice 254 through it. The ferrule 250 has a body portion 258 and a retaining portion 262. The body portion 258 has a first end 266 and a second end 270 and is sized and shaped to fit slidably through the orifice 58 in the threaded nut 54. The body portion 258 is fixedly and conductively attached at its first end 266 to the second end 42 of the elbow tube 34. The retaining portion 262 has a first end 274 and a second end 278. The first end 274 extends from the second end 270 of the body portion 258 and is sized and shaped to bear rotatably against the retaining lip 70 of the threaded nut 54. The second end 278 of the retaining portion 262 includes a cylindrical recess 282.

The improvement includes a coil spring 286. The coil spring 286 has a first end 290 and a second end 294 and is sized and shaped to fit slidably within the cylindrical recess 282. A retainer 298 is provided. The retainer 298 is sized and shaped to fit slidably within the cylindrical recess 282 adjacent the second end 294 of the coil spring 286. A cylindrical grommet 302 is provided. The grommet 302 has a first end 306, a second end 310, is formed of resilient, insulating material 314. The grommet 302 is sized and shaped to fit slidably over the inner insulating layer 26 of the cable 14. The grommet 302 includes a surrounding shoulder 318 located adjacent the first end 306. The shoulder 318 is sized and shaped to fit frictionally within the cylindrical recess 282 in the second end 278 of the retaining portion 262 of the ferrule 250.

A spark plug contact button 322 is provided. The button 322 is fixedly and conductively attached to the center conductor 30 of the cable 14 adjacent the second end 310 of the grommet 302. A cylindrical protector cap 326 is provided. The cap 326 is formed of insulating material 330 and includes an inner chamber 334 and an external thread 338. The thread 338 is size and shaped to engage the internal thread 74 of the threaded nut 54. When the protector cap 326 is unthreaded from the threaded nut 54 and a spark plug 342 of an aircraft engine 346 is inserted into the cap 326 and threaded into an engine cylinder head 350 with the spark plug contact button 322 bearing against a central spark plug conductor 354 and when the threaded nut 54 is threaded onto said external thread 338 of the cap 326, the coil spring 286 will be compressed, causing the spark plug contact button 322 to be urged against said central spark plug conductor 354, thereby providing a moisture-resistant connection between the cable 14 and the sparkplug 342.

(5) In yet another variant, as illustrated in FIG. 8, the flexible, conducting, elbow tube 34 is formed from a sheet of malleable metallic material 202. The sheet 202 has first (not shown) and second 210, opposed parallel edges and third (not shown) and fourth (not shown), opposed parallel edges normal to the first and second 210 edges. The sheet 202 has a series of single, back to back folds 222 parallel to the third and fourth edges. The sheet 202 is formed about a cylindrical mandrel (not shown). A long axis (not shown) of the mandrel is perpendicular to the folds 222. The first and second 210 edges are joined to form an open-ended cylindrical tube 234.

(6) In a further variant, as illustrated in FIG. 9, the flexible, conducting, elbow tube 34 is formed from a sheet of malleable metallic material 202. The sheet has first (not shown) and second 210, opposed parallel edges and third (not shown) and fourth (not shown), opposed parallel edges normal to the first and second 210 edges. The sheet 202 has a series of single, back to back folds 222 parallel to the third and fourth edges. Lower portions 238 of the folds 222 are doubled back upon themselves so as to provide four layers of metallic material 240 adjacent to a lower surface 242 of the sheet 202. The sheet 202 is formed about a cylindrical mandrel (not shown) with the lower surface 242 outermost. A long axis (not shown) of the mandrel is perpendicular to the folds 222. The first and second 210 edges are joined to form an open-ended cylindrical tube 246 that has a reinforced outer surface 248.

(7) In still a further variant, as illustrated in FIGS. 2, 4 and 5-7, an insulating sleeve 358 is provided. The sleeve 358 has a first end 362, a second end 366, is sized and shaped to fit slidably over the inner insulating layer 26 and is located adjacent a posterior end 370 of the cable 14. The insulating sleeve 358 is sized and shaped to fit slidably within a receiving collar 434 of a magneto plate 438. A contact button 374 is provided. The button 374 is attached to a posterior end 378 of the center conductor 30 of the ignition cable 14. An externally threaded nut 382 is provided. The nut 382 has a central orifice 386 through it. The nut 382 has an anterior end 390, a posterior end 394, an external bearing surface 398 at the posterior end 394. A support ferrule 402 is provided. The ferrule 402 has a first end 406, a second end 410 and a central opening 414 extending from the first end 406 to the second end 410. The opening 414 is sized to fit slidably over the inner insulating layer 26. The first end 406 of the support ferrule 402 is sized and shaped to fit within the externally threaded nut 382. The second end 410 of the support ferrule 402 is sized and shaped to bear against the external bearing surface 398 of the externally threaded nut 382.

A sealing grommet 418 is provided. The grommet 418 has an anterior end 422, a posterior end 426 and is formed of resilient material 430. The grommet 418 has a central aperture 442 extending from the anterior end 422 to the posterior end 426. The central aperture 442 is sized to fit slidably over the insulating sleeve 358. The sealing grommet 418 is compressed to seal against the magneto plate 438 when the externally threaded nut 382 is attached to and tightened into the receiving collar 434, and said magneto plate 438 is attached to a magneto (not shown) thereby providing an airtight seal (not shown) for the connection to the magneto plate 438 and said magneto.

(8) In a final variant, as illustrated in FIGS. 2, 4 and 5-7, an insulating sleeve 358 is provided. The sleeve 358 has a first end 362, a second end 366, is sized and shaped to fit slidably over the inner insulating layer 26 and is located adjacent a posterior end 370 of the cable 14. The insulating sleeve 358 is sized and shaped to fit slidably within a receiving collar 434 of a magneto plate 438. A contact button 374 is provided. The button 374 is attached to a posterior end 378 of the center conductor 30 of the ignition cable 14. An externally threaded nut 382 is provided. The nut 382 has a central orifice 386 through it. The nut 382 has an anterior end 390, a posterior end 394, an external bearing surface 398 at the posterior end 394. A support ferrule 402 is provided. The ferrule 402 has a first end 406, a second end 410 and a central opening 414 extending from the first end 406 to the second end 410. The opening 414 is sized to fit slidably over the inner insulating layer 26. The first end 406 of the support ferrule 402 is sized and shaped to fit within the externally threaded nut 382. The second end 410 of the support ferrule 402 is sized and shaped to bear against the external bearing surface 398 of the externally threaded nut 382.

A sealing grommet 418 is provided. The grommet 418 has an anterior end 422, a posterior end 426 and is formed of resilient material 430. The grommet 418 has a central aperture 442 extending from the anterior end 422 to the posterior end 426. The central aperture 442 is sized to fit slidably over the insulating sleeve 358. The sealing grommet 418 is compressed to seal against the magneto plate 438 when the externally threaded nut 382 is attached to and tightened into the receiving collar 434, and said magneto plate 438 is attached to a magneto (not shown) thereby providing an airtight seal (not shown) for the connection to the magneto plate 438 and said magneto.

The improved general aviation igniter cable assembly 10 has been described with reference to particular embodiments. Other modifications and enhancements can be made without departing from the spirit and scope of the claims that follow.

The invention claimed is:

1. An improved general aviation igniter cable assembly, wherein said assembly comprises:

a radio-shielded ignition cable, said cable having an outer insulating cover, a shielding conductor, an inner insulating layer, and a center conductor;

a flexible, conducting, elbow tube, said elbow tube having a first end and a second end and being fixedly and conductively attached at its first end to the shielding conductor of said cable;

said elbow tube retains a particular shape after bending;

a sealing sleeve, said sleeve joining said outer insulating cover to the first end of said elbow tube;

a threaded nut, said nut having a central orifice therethrough, a first end, a second end, a retaining lip at said first end and an internal thread extending from said second end toward said retaining lip;

a conducting ferrule, said ferrule being cylindrical in shape, having a central orifice therethrough, and having a body portion and a retaining portion;

said body portion having a first end and a second end and being sized and shaped to fit slidably through the orifice in the threaded nut and being fixedly and conductively attached at its first end to the second end of the elbow tube;

said retaining portion having a first end and a second end, said first end extending from the second end of the body portion and being sized and shaped to bear rotatably against the retaining lip of the threaded nut;

aid second end of said retaining portion including a cylindrical recess;

a cylindrical grommet, said grommet having a first end, a second end, being formed of resilient, insulating material and being sized and shaped to fit slidably over the inner insulating layer of the cable, said grommet including a surrounding shoulder disposed between said first end and said second end;

a retainer, said retainer being sized and shaped to fit slidably over said first end of said grommet and bear against said surrounding shoulder;

a spark plug contact button, said button being fixedly and conductively attached to said center conductor of said cable adjacent said second end of said grommet;

a cylindrical protector cap, said cap formed of insulating material and including an inner chamber and an external thread, said thread being size and shaped to engage the internal thread of the threaded nut;

said improvement comprising:

a double coil spring, said double coil spring having an inner portion and an outer portion;

said outer portion having a first end and a second end, said first end, being sized and shaped to rotatably engage said cylindrical recess;

said outer portion being sized and shaped to surround said first end of said grommet with said second end bearing against said retainer;

said inner portion being disposed within said outer portion, having a proximate end and a distal end, said distal end being sized and shaped to bear against said first end of said grommet and put pressure on said spark plug contact button; and whereby, when said protector cap is unthreaded from said threaded nut and a spark plug of an aircraft engine is inserted into said cap and threaded into an engine cylinder head with said spark plug contact button bearing against a central spark plug conductor and when said threaded nut is threaded onto said external thread of said cap, the double coil spring will be compressed, causing the spark plug contact button to bear against the central spark plug conductor, thereby providing a moisture-resistant connection between the cable and the sparkplug.

2. The improved general aviation igniter cable assembly as described in claim 1 wherein the flexible, conducting, elbow tube is formed from a sheet of malleable metallic material, said sheet having first and second, opposed parallel edges and third and fourth, opposed parallel edges normal to said first and second edges, a series of single, back to back folds parallel to said third and fourth edges, said sheet being formed about a cylindrical mandrel, a long axis of said mandrel being perpendicular to said folds, said first and second edges being joined to form an open-ended cylindrical tube.

3. The improved general aviation igniter cable assembly as described in claim 1 wherein the flexible, conducting, elbow tube is formed from a sheet of malleable metallic material, said sheet having first and second, opposed parallel edges and third and fourth, opposed parallel edges normal to said first and second edges, a series of single, back to back folds parallel to said third and fourth edges, lower portions of said folds being doubled back upon themselves so as to provide four layers of metallic material adjacent a lower surface of said sheet, said sheet being formed about a cylindrical mandrel with said lower surface outermost, a long axis of said mandrel being perpendicular to said folds, said first and second edges being joined to form an open-ended cylindrical tube having a reinforced outer surface.

4. An improved general aviation igniter cable assembly, comprising:

a radio-shielded ignition cable, said cable having an outer insulating cover, a shielding conductor, an inner insulating layer, and a center conductor;

a flexible, conducting, elbow tube, said tube having a first end and a second end and being fixedly and conductively attached at its first end to the shielding conductor of said cable;

said elbow tube retains a particular shape after bending;

a sealing sleeve, said sleeve joining said outer insulating cover to the first end of said elbow tube;

a threaded nut, said nut having a central orifice therethrough, a first end, a second end, a retaining lip at said first end and an internal thread extending from said second end toward said retaining lip;

a conducting ferrule, said ferrule being cylindrical in shape, having a central orifice therethrough, and having a body portion and a retaining portion;

said body portion having a first end and a second end and being sized and shaped to fit slidably through the orifice in the threaded nut and being fixedly and conductively attached at its first end to the second end of the elbow tube;

said retaining portion having a first end and a second end, said first end extending from the second end of the body portion and being sized and shaped to bear rotatably against the retaining lip of the threaded nut;

said second end of said retaining portion including a cylindrical recess;

said improvement comprising:

a coil spring, said coil spring having a first end and a second end and being sized and shaped to fit slidably within said cylindrical recess;

a retainer, said retainer being sized and shaped to fit slidably within said cylindrical recess adjacent said second end of said coil spring;

a cylindrical grommet, said grommet having a first end, a second end, being formed of resilient, insulating material and being sized and shaped to fit slidably over the inner insulating layer of the cable, said grommet including a surrounding shoulder disposed adjacent said first end, said shoulder sized and shaped to fit frictionally within the cylindrical recess in said second end of the retaining portion of the ferrule;

a spark plug contact button, said button being fixedly and conductively attached to the center conductor of the cable adjacent the second end of the grommet;

a cylindrical protector cap, said cap formed of insulating material and including an inner chamber and an external thread, said thread being size and shaped to engage the internal thread of the threaded nut; and whereby, when said protector cap is unthreaded from said threaded nut and a spark plug of an aircraft engine is inserted into said cap and threaded into an engine cylinder head with said spark plug contact button bearing against a central spark plug conductor and when said threaded nut is threaded onto said external thread of said cap, the coil spring will be compressed, causing the spark plug contact button to bear against the central spark plug conductor, thereby providing a moisture-resistant connection between the cable and the sparkplug.

5. The improved general aviation igniter cable assembly, as described in claim 4, wherein the flexible, conducting, elbow tube is formed from a sheet of malleable metallic material, said sheet having first and second, opposed parallel edges and third and fourth, opposed parallel edges normal to said first and second edges, a series of single, back to back folds parallel to said third and fourth edges, said sheet being formed about a cylindrical mandrel, a long axis of said mandrel being perpendicular to said folds, said first and second edges being joined to form an open-ended cylindrical tube.

6. The improved general aviation igniter cable assembly, as described in claim 4, wherein the flexible, conducting, elbow tube is formed from a sheet of malleable metallic material, said sheet having first and second, opposed parallel edges and third and fourth, opposed parallel edges normal to said first and second edges, a series of single, back to back folds parallel to said third and fourth edges, lower portions of said folds being doubled back upon themselves so as to provide four layers of metallic material adjacent a lower surface of said sheet, said sheet being formed about a cylindrical mandrel with said lower surface outermost, a long axis of said mandrel being perpendicular to said folds, said first and second edges being joined to form an open-ended cylindrical tube having a reinforced outer surface.

7. The improved general aviation igniter cable assembly, as described in claim 1, further comprising:

an insulating sleeve, said sleeve having a first end, a second end and being sized and shaped to fit slidably over said inner insulating layer and being disposed adjacent a posterior end of said cable;

said insulating sleeve being sized and shaped to fit slidably within a receiving collar of a magneto plate;

a contact button, said button being attached to a posterior end of said center conductor of said ignition cable;

an externally threaded nut, said nut having a central orifice therethrough, an anterior end, a posterior end, an external bearing surface at said posterior end;

a support ferrule, said ferrule having a first end, a second end and a central opening extending from said first end to said second end;

said opening being sized to fit slidably over said inner insulating layer;

said first end of said support ferrule being sized and shaped to fit within said externally threaded nut;

said second end of said support ferrule being sized and shaped to bear against said external bearing surface of said externally threaded nut;

a sealing grommet, said grommet having an anterior end, a posterior end, being formed of resilient material, and having a central aperture extending from said anterior end to said posterior end;

said central aperture being sized to fit slidably over said insulating sleeve; and said sealing grommet being compressed to seal against said said magneto plate when said externally threaded nut is attached to and tightened into said receiving collar and said magneto plate is attached to a magneto, thereby providing an airtight seal for said connection to said magneto plate and said magneto.

8. The improved general aviation igniter cable assembly, as described in claim 4, further comprising:

an insulating sleeve, said sleeve having a first end, a second end and being sized and shaped to fit slidably over said inner insulating layer and being disposed adjacent a posterior end of said cable;

said insulating sleeve being sized and shaped to fit slidably within a receiving collar of a magneto plate;

a contact button, said button being attached to a posterior end of said center conductor of said ignition cable;

an externally threaded nut, said nut having a central orifice therethrough, an anterior end, a posterior end, an external bearing surface at said posterior end;

a support ferrule, said ferrule having a first end, a second end and a central opening extending from said first end to said second end;

said opening being sized to fit slidably over said inner insulating layer;

said first end of said support ferrule being sized and shaped to fit within said externally threaded nut;

said second end of said support ferrule being sized and shaped to bear against said external bearing surface of said externally threaded nut;

a sealing grommet, said grommet having an anterior end, a posterior end, being formed of resilient material, and having a central aperture extending from said anterior end to said posterior end;

said central aperture being sized to fit slidably over said insulating sleeve; and said sealing grommet being compressed to seal against said said magneto plate when said externally threaded nut is attached to and tightened into said receiving collar and said magneto plate is attached to a magneto, thereby providing an airtight seal for said connection to said magneto plate and said magneto.

* * * * *